United States Patent [19]

Sato

[11] Patent Number: 4,875,789

[45] Date of Patent: Oct. 24, 1989

[54] INK RIBBON CASSETTE WITH SLIDABLE RIBBON GUIDE

[75] Inventor: Hiroyuki Sato, Tokyo, Japan

[73] Assignee: Seikosha Co., Ltd., Japan

[21] Appl. No.: 135,842

[22] Filed: Dec. 21, 1987

[30] Foreign Application Priority Data

Dec. 19, 1986 [JP] Japan ..... 61-195517[U]

[51] Int. Cl.[4] ..... B41J 32/02

[52] U.S. Cl. ..... 400/196.1; 400/208; 400/216.1; 400/240; 400/240.4; 400/248

[58] Field of Search ..... 400/194, 195, 196, 196.1, 400/207, 208, 208.1, 216.1, 240, 240.4, 248

[56] References Cited

U.S. PATENT DOCUMENTS

| | | | |
|---|---|---|---|
| 3,904,017 | 9/1975 | Frechette | 400/208 X |
| 4,543,002 | 9/1985 | Bittner et al. | 400/216.1 X |
| 4,600,325 | 7/1986 | Okamoto et al. | 400/208 |
| 4,650,355 | 3/1987 | Cassiano et al. | 400/216.1 X |

FOREIGN PATENT DOCUMENTS

| | | | |
|---|---|---|---|
| 0255475 | 12/1985 | Japan | 400/196.1 |
| 0010479 | 1/1986 | Japan | 400/208 |
| 0083086 | 4/1986 | Japan | 400/208 |
| 0249785 | 11/1986 | Japan | 400/240 |
| 2179893 | 3/1987 | United Kingdom | 400/240 |

*Primary Examiner*—Ernest T. Wright, Jr.

*Attorney, Agent, or Firm*—Bruce L. Adams; Van C. Wilks

[57] ABSTRACT

An ink ribbon cassette is removably mounted on a printer and coacts with a reciprocable printing head to effect a printing operation. The cassette has a case containing an ink ribbon, and a pair of arms extending in opposed relation from opposite ends of the case and having slits through which the ink ribbon extends to form an exposed ribbon portion in the region between the arms. A ribbon guide is slideable along a guide shaft mounted on the case and is releasably carried on the printing head to reciprocate together with the printing head during the printing operation for guiding the ink ribbon. The ribbon guide has sets of retaining claws which slidably engage lengthwise with the upper and lower marginal edge portions of the ink ribbon for restricting vertical displacement of the ink ribbon relative to the case while allowing lengthwise sliding movement of the ink ribbon. By such a construction, slackening of the exposed ribbon portion is prevented and a predetermined confronting positional relation between the ink ribbon and the printing head is maintained.

20 Claims, 3 Drawing Sheets

INK RIBBON CASSETTE WITH SLIDABLE RIBBON GUIDE

BACKGROUND OF THE INVENTION

The present invention relates generally to printers and, more particularly, to printers using an ink ribbon cassette in which an ink ribbon is positioned to face a printing head within the range of reciprocation of the printing head.

An ink ribbon cassette of the prior art has a pair of arms integrally extending from opposite end portions thereof, the cassette case being longer than the reciprocating range of the printing head. Ribbon take-out and take-in slits are formed in the ends of the respective arms for exposing a portion of an ink ribbon contained within the cassette. Thus, the printing head and the ink ribbon are positioned to face each other within the range of reciprocation of the printing head while exposing the ink ribbon to the outside between the ribbon take-out and take-in slits.

In case, however, such a prior art ribbon cassette is used in a printer having a long range of reciprocation of the printing head, the cassette case has to be elongated. This, in turn, enlarges the distance between the ribbon take-out and take-in slits so that the ink ribbon portion exposed between the ribbon take-out and take-in slits becomes slackened. The slackening of the exposed ink ribbon portion alters the facing positional relationship between the printing head and the ink ribbon. This is disadvantageous in that the printing head and the ink ribbon fail to accurately face each other. In the prior art, this disadvantage is coped with by enlarging the width of the ink ribbon which has the drawback of increasing the thickness of the ribbon cassette. This disadvantage is especially serious in the case of using a multi-color ink ribbon having a plurality of lengthwise extending color bands. When using a multi-color ink ribbon, a color band switching device is used to shift the ribbon so that different color bands face the printing head, and the positional relationship between each color band and the printing head is displaced as the ribbon slackens thereby making it difficult if not impossible to perform the desired multi-color printing operation. For making multi-color prints of high quality, strict alignment of the positions of the ink ribbon and printing head is indispensable.

SUMMARY OF THE INVENTION

It is, therefore, an object of the present invention to provide an ink ribbon cassette which overcomes the disadvantages of the prior art devices.

It is another object of the present invention to provide an ink ribbon cassette which maintains a constant positional relationship between the facing positions of the printing head and the ink ribbon to make prints of high quality even in case the ribbon take-out and take-in slits are spaced a long distance apart.

The above and other objects are achieved by means of a cassette case charged with an ink ribbon and having a pair of arms integrally extending from opposite end portions thereof and opened at their leading ends to form ribbon take-out and take-in slits between which the ink ribbon is exposed to the outside. The cassette case is provided with a ribbon guide slidably supported on a guide shaft and disposed to move vertically with respect to a horizontally reciprocable printing head and to move horizontally together with the printing head.

The ribbon guide is provided with restricting means for allowing the exposed portion of the ink ribbon to slide lengthwise therethrough in the vicinity of the tip of the printing head while restricting vertical movement of the exposed portion of the ink ribbon with respect to the cassette case. The exposed portion of the ink ribbon is forced without fail to face the printing head at a predetermined positional relationship via the restricting means.

DETAILED DESCRIPTION OF THE INVENTION

The present invention will be described hereinafter in conjunction with one embodiment thereof with reference to the accompanying drawings.

Figures 1A, 1B:
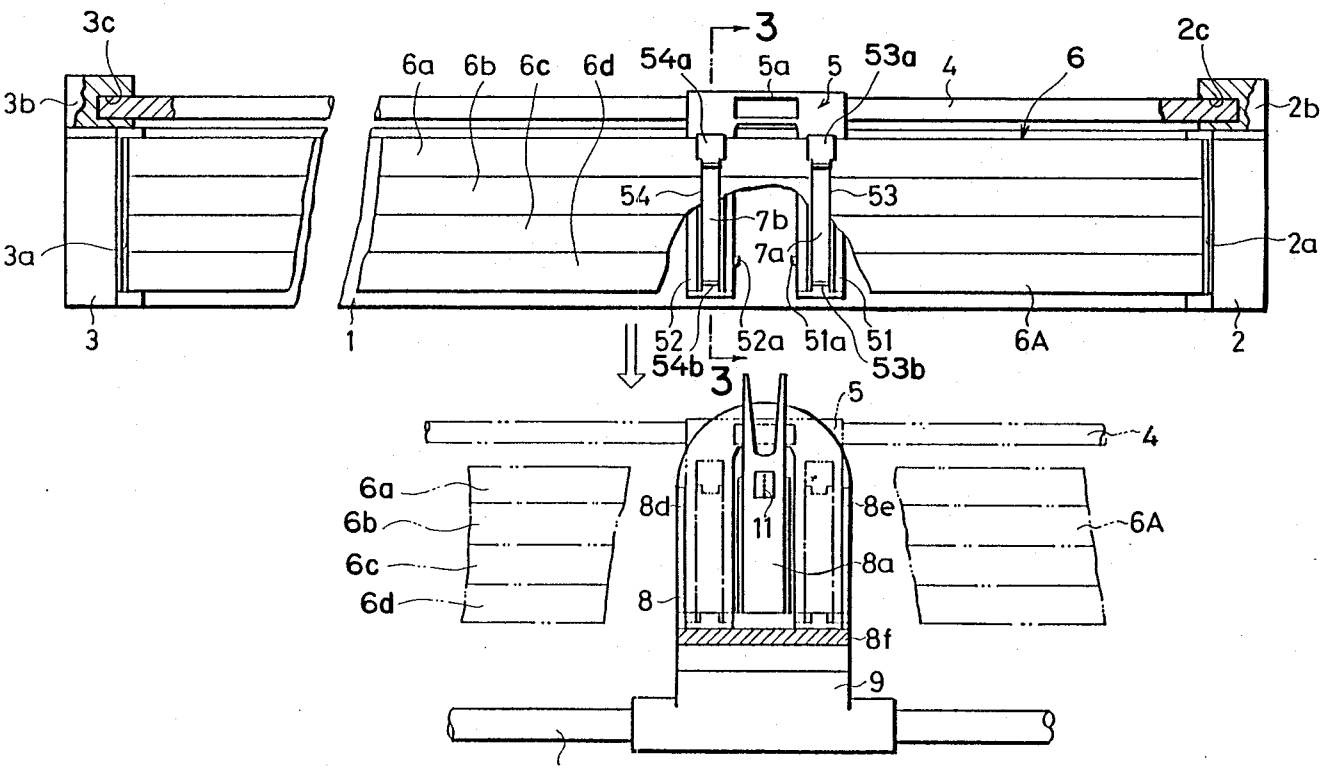
FIG. 1A is a front elevational view of an ink ribbon cassette according to the present invention and FIG. 1B is a front elevational view of a printing head showing the positional relationship between the cassette and printing head.
Figure 2:
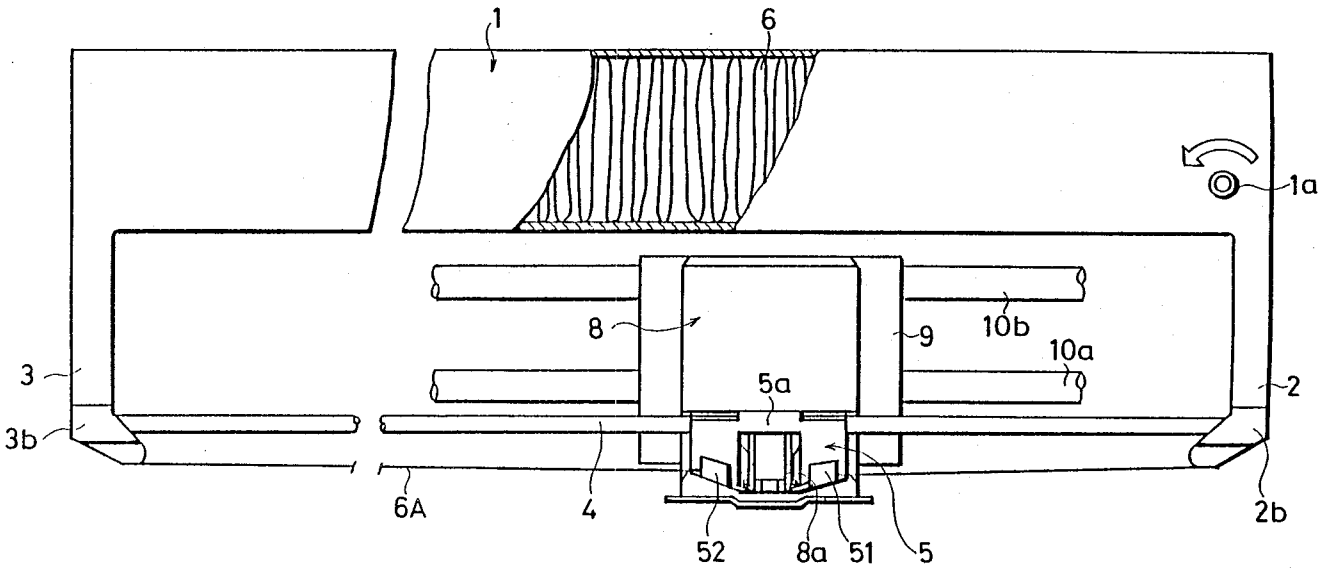
FIG. 2 is a top plan view, partly cut away, showing the ink ribbon cassette mounted on the printing head.

As shown in FIGS. 1A and 2, a cassette case 1 has a pair of arms 2 and 3 extending integrally from opposite end portions of the cassette case 1 to form a ribbon take-in slit 2*a* and a ribbon take-out slit 3*a*. The arms 2 and 3 are formed with upwardly extending projections 2*b* and 3*b* which have openings 2*c* and 3*c* therein for receiving and supporting a guide shaft 4 which extends parallel to the direction of movement of a rigid printing head 8. A ribbon guide 5 is slidably supported on the guide shaft 4 by means of a mount portion 5*a* which is slidably mounted on the guide shaft 4.

Figure 3:
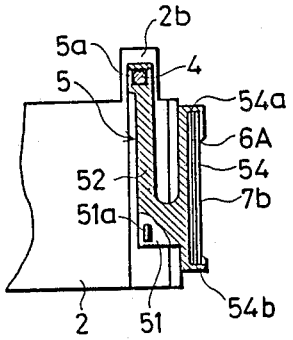
FIG. 3 is a partial cross-sectional view taken along line 3—3 of FIG. 1A.

The mount portion 5*a* has a pair of legs 51 and 52 which depend downwardly in spaced-apart relation and which define therebetween a predetermined gap. The legs 51 and 52 are formed at their lower end portions with lateral engagement projections 51*a* and 52*a*. From the legs 51 and 52, there extend forward engagement arms 53 and 54 of generally C-shaped section (as shown in FIG. 3) which slidably engage with the exposed portion 6A of an ink ribbon 6. The engagement arms 53 and 54 are formed at their upper and lower end portions with retaining claws 53*a* and 54*a*, and 53*b* and 54*b*, respectively, which slidably engage with the upper and lower edges of the exposed ribbon portion 6A. The retaining claws 53*a* , 54*a*, 53*b* and 54*b* jointly constitute restricting means for restricting vertical movement of the exposed ribbon portion 6A with respect to the cassette case 1. Thin elastic plates 7*a* and 7*b* are inserted between the retaining claws 53*a* and 53*b* and between the retaining claws 54*a*, and 54*b*, respectively, for ensuring the sliding engagement of the ink ribbon 6 with the ribbon guide 5.

The ink ribbon 6 comprises a multi-color printing endless ink ribbon composed of a plurality of colored ink bands 6*a*, 6*b*, 6*c* and 6*d* which extend lengthwise of the ink ribbon 6 in parallel relation and which are impregnated with ink of different colors, respectively. The endless ink ribbon 6 is fed lengthwise in the longitudinal direction by means of a drive roller la disposed in the cassette case 1 by the action of a ribbon feeder (not shown) disposed in a printer body (not shown). The remaining portion of the ink ribbon 6 other than the exposed portion 6A extending between the ribbon take-out and take-in slits 3a and 2a is stored in zigzag form in the cassette case 1, as shown in FIG. 2.

Figure 4:
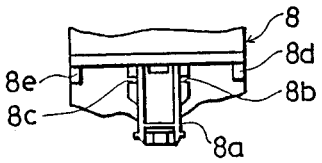
FIG. 4 is a partially cut-away top plan view of the printing head.
Figure 5:
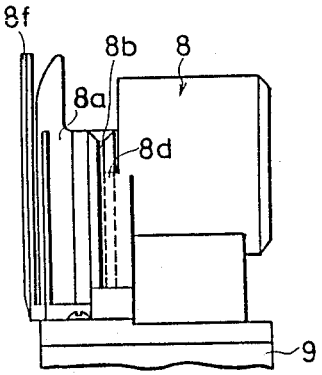
FIG. 5 is a side elevational view of the printing head.

The printing head 8 is slidably supported on print guide 10a and 10b via a carriage 9. The printing head 8 includes a print wire guide 8a which is formed at its opposite side walls with vertical engagement grooves 8b and 8c as best seen in FIGS. 4 and 5. The engagement grooves 8b and 8c are dimensioned to slidably receive therein the lateral engagement projections 51a and 52a of the ribbon guide legs 51 and 52. By such a construction, the ribbon guide 5 together with the exposed ribbon portion 6A can be displaced vertically relative to the printing head 8 and, during such vertical displacement, the engagement projections 51a and 52a vertically slide in the vertical engagement grooves 8b and 8c of the wire guide 8a. The print wire guide 8a has an array of printing wires 11 slidably inserted therein to undergo selective actuation to strike the ink ribbon 6 in a manner well known in the art. The printing head 8 further includes a pair of vertical ribs 8d and 8e which slidably engage with the sides of the ribbon guide legs 51 and 52, and a front cover 8f.

During use, the cassette case 1 is removably mounted on a conventional color band switching device (not shown) of the printer (not shown). As shown in FIG. 1, the ribbon guide 5 is mounted vertically movably on the printing head 8 by bringing the engagement projections 51a and 52a of the ribbon guide 5 into sliding engagement with the engagement grooves 8b and 8c of the printing head 8, respectively, and by sliding the ribbon guide 5 downwardly. In this manner, the ribbon guide 5 is carried integrally with the printing head 8 and slides along the guide shaft 4 via the mount portion 5a, and the ribbon guide 5 can move in sliding engagement with the exposed portion 6A of the ink ribbon 6 at a constant vertical position with respect to the cassette case 1 while restricting movement of the exposed ribbon portion 6A in the vertical direction. As a result, the exposed portion 6A of the ink ribbon 6 will not become slack, even if the distance between the ribbon take-in and take-out slits 2a and 3a is made long, so that the ink ribbon 6 always faces the printing head 8 with a predetermined positional relationship.

During multi-color printing operations, the cassette case 1 is vertically displaced a predetermined distance by the color band switching device (not shown) so as to selectively bring one of the color bands 6a, 6b, 6c and 6d into a suitable position to face the printing wires 11 in accordance with the color to be printed. At this time, as the ribbon guide 5 is slidably supported on the guide shaft 4 so as to move in accordance with the vertical movements of the cassette case 1, the ribbon guide 5 effectively restricts vertical movement of the ink ribbon 6 relative to the cassette case 1 while holding the longitudinal position of the ink ribbon 6 relative to the cassette case 1. By such a construction, the ink ribbon 6 accurately follows the vertical movements of the cassette case 1 so that a predetermined color band accurately faces the printing wires 11 of the printing head 8 in the predetermined positional relationship.

According to the present invention, the positional relationship between the printing head and the exposed portion of the ink ribbon remains constant for each color band, even in case the distance between the ribbon take-out and take-in slits is long, so that the printing head and the exposed ribbon portion always face one another in an accurate positional relationship. As a result, the ribbon cassette can be made thinner without enlarging the width of the ink ribbon more than necessary. Moreover, the positional adjustment of the ink ribbon during assembly is facilitated thereby improving the working efficiency and reducing the production cost.

What is claimed is:

1. An ink ribbon cassette for use with a printer having a reciprocable printing head which reciprocates along an axis during use of the printer, the ink ribbon cassette comprising: a cassette case having a pair of arms extending outwardly therefrom in opposed spaced-apart relationship, the arms having openings therein; an ink ribbon disposed to undergo lengthwise movement within the cassette case with a portion thereof slidably extending through the openings and bridging the space between the arms to define an exposed ribbon portion; a guide shaft supported by the cassette case and extending substantially parallel to the axis of reciprocation of the printing head; a ribbon guide slideable along the guide shaft and slidably engaging with the exposed ribbon portion, the ribbon guide having means directly slidably engageable with the printing head to enable the ribbon guide to undergo vertical displacement relative to the printing head and to follow the reciprocal movement of the printing head; and restricting means carried by the ribbon guide for restricting vertical displacement of the exposed ribbon portion relative to the cassette case while allowing lengthwise sliding movement of the exposed ribbon portion relative to the ribbon guide to thereby prevent slackening of the exposed ribbon portion.

2. An ink ribbon cassette according to claim 1; wherein the means directly engageable with the printing head comprises a set of projections on the ribbon guide, the projections being configured to slide in vertical grooves in the printing head.

3. An ink ribbon cassette according to claim 1; wherein the means directly slidably engageable with the printing head comprises a pair of spaced-apart legs extending downwardly from the ribbon guide, the legs being configured to slide vertically in complementary parts of the printing head to thereby enable vertical displacement of the ribbon guide relative to the printing head while enabling the ribbon guide to be carried by the printing head to undergo reciprocal movement along the guide shaft according to the reciprocal movement of the printing head.

4. An ink ribbon cassette according to claim 3; including a pair of projections on respective ones of the legs, the projections being configured to slide in vertical grooves in the printing head.

5. An ink ribbon cassette according to claim 3; wherein the restricting means comprises means carried by the ribbon guide for slidably engaging with the upper and lower marginal edge portions of the exposed ribbon portion.

6. An ink ribbon cassette according to claim 5; wherein the means for slidably engaging comprises means for slidably engaging with the upper and lower marginal edge portions of the exposed ribbon portion at two spaced-apart locations therealong.

7. An ink ribbon cassette according to claim 5; wherein the means for slidably engaging comprises upper and lower retaining claws.

8. An ink ribbon cassette according to claim 5; wherein the ink ribbon comprises a multi-color ink ribbon having a plurality of color bands extending lengthwise of the ribbon, each band being impregnated with a different color ink.

9. An ink ribbon cassette according to claim 1; wherein the ink ribbon comprises a multi-color ink ribbon having a plurality of color bands extending lengthwise of the ribbon, each band being impregnated with a different color ink.

10. An ink ribbon cassette according to claim 1; wherein the restricting means comprises means carried by the ribbon guide for slidably engaging with the upper and lower marginal edge portions of the exposed ribbon portion.

11. An ink ribbon cassette according to claim 10; wherein the means for slidably engaging comprises means for slidably engaging with the upper and lower marginal edge portions of the exposed ribbon portion at two spaced-apart locations therealong.

12. An ink ribbon cassette according to claim 11; wherein the means for slidably engaging comprises upper and lower retaining claws.

13. An ink ribbon cassette according to claim 10; wherein the ink ribbon comprises a multi-color ink ribbon having a plurality of color bands extending lengthwise of the ribbon, each band being impregnated with a different color ink.

14. A printer comprising:

an ink ribbon cassette having a cassette body charged with an ink ribbon, and spaced-apart arms extending outwardly of the cassette body and between which extends an exposed portion of the ink ribbon;

a printing head disposed adjacent to the exposed portion of the ink ribbon and mounted to undergo reciprocal movement longitudinally thereof;

a rigid guide shaft supported on the cassette body and extending substantially parallel to the direction of movement of the printing head;

a ribbon guide slidably received on the guide shaft and slidably engaged with a portion of the printing head so as to move vertically relative to the printing head and to follow the reciprocal movement of the printing head; and restricting means carried by the ribbon guide for restricting vertical movement of the exposed portion of the ink ribbon while allowing the exposed portion of the ink ribbon to slide longitudinally through the ribbon guide.

15. A printer as claimed in claim 14; in which the ribbon guide is provided with one of engaging projections and engaging grooves, and the printing head has a nose portion provided with the other of the engaging projections and the engaging grooves, the ribbon guide being slidably engaged with the nose portion of the printing head by means of the engaging projections and the engaging grooves.

16. A printer as claimed in claim 15; in which the printing head and the ribbon guide have interengaging legs and rib portions.

17. A printer as claimed in claim 14; in which the restricting means comprises at least one pair of claws slidably engageable with opposite longitudinally extending edges of the exposed portion of the ink ribbon.

18. A printer as claimed in claim 17; in which there are two pairs of claws each pair of which comprises a U-shaped structure carried by the ribbon guide.

19. A printer as claimed in claim 14; in which the ribbon guide has resilient means for ensuring engagement between the exposed portion of the ink ribbon and the ribbon guide.

20. A printer as claimed in claim 14; in which the ink ribbon has a plurality of parallel, longitudinally extending bands impregnated with inks of different colors.

* * * * *